US007434603B2

(12) United States Patent
Spear et al.

(10) Patent No.: US 7,434,603 B2
(45) Date of Patent: Oct. 14, 2008

(54) BOTTOM LOAD WATER COOLER

(75) Inventors: Gregory N Spear, Los Angeles, CA (US); Terry Havener, Martinsville, IN (US); Chun Yen Wang, Ormond Beach, FL (US); Hung Hsiang Chen, Ormond Beach, FL (US)

(73) Assignee: MTN Products, Inc., Pomona, CA (US)

( * ) Notice: Subject to any disclaimer, the term of this patent is extended or adjusted under 35 U.S.C. 154(b) by 140 days.

(21) Appl. No.: 11/468,380

(22) Filed: Aug. 30, 2006

(65) Prior Publication Data

US 2008/0053564 A1 Mar. 6, 2008

(51) Int. Cl.

| | |
|---|---|
| ***B67C 3/26*** | (2006.01) |
| ***B67C 3/00*** | (2006.01) |
| ***B65B 3/04*** | (2006.01) |
| ***B65B 3/00*** | (2006.01) |
| ***E03B 11/00*** | (2006.01) |
| ***B67D 5/64*** | (2006.01) |
| ***B65D 88/54*** | (2006.01) |

(52) U.S. Cl. ..... 141/363; 141/82; 141/284; 141/320; 137/581; 222/164; 222/325

(58) Field of Classification Search ..... 141/319–322, 141/363–364, 273, 284, 352, 82; 137/581; 222/160, 164, 325

See application file for complete search history.

(56) References Cited

U.S. PATENT DOCUMENTS

| | | | | |
|---|---|---|---|---|
| 1,241,352 | A | | 1/1917 | Doering et al. |
| 1,248,705 | A | | 12/1917 | Pouge |
| 1,319,376 | A | | 10/1919 | Cooper |
| 1,337,206 | A | | 4/1920 | Doering et al. |
| 1,933,192 | A | | 10/1933 | Taylor |
| 1,948,644 | A | | 2/1934 | Blood et al. |
| 1,960,604 | A | | 5/1934 | Van Fleet |
| 1,976,007 | A | | 10/1934 | Cullen et al. |
| 2,057,238 | A | | 10/1936 | Krug |
| 2,072,629 | A | | 3/1937 | Fernholz |
| 2,191,918 | A | * | 2/1940 | Stadtfeld ..... 222/131 |
| 2,388,111 | A | * | 10/1945 | Berman ..... 222/165 |
| 2,689,669 | A | | 9/1954 | Ericson |
| 2,811,272 | A | | 10/1957 | Lawlor |
| 3,033,247 | A | | 5/1962 | Beall, Jr. |
| 3,193,143 | A | | 7/1965 | Maieli |
| 3,207,190 | A | | 9/1965 | Silbereis et al. |
| 3,341,073 | A | | 9/1967 | Arps et al. |

(Continued)

OTHER PUBLICATIONS

Bottom Loading Water Dispenser, by Shenzhen Angel Aquaworks Co., Ltd., China; Dec. 14, 2004; 2 pages.*

(Continued)

*Primary Examiner*—Gregory Hudson
*Assistant Examiner*—Nicolas A Arnett
(74) *Attorney, Agent, or Firm*—Michael P. Mazza, LLC

(57) ABSTRACT

A liquid dispensing apparatus and method for using same, including a dispenser for dispensing liquid such as water to a user. A liquid container is located below the dispenser and removably attachable to a pivoting cradle engaging the liquid container. The cradle may be pivoted about an axis located adjacent an exit location for liquid within the liquid container. A filling device may be located below the liquid container for removably engaging the liquid container in fluid communication.

16 Claims, 8 Drawing Sheets

U.S. PATENT DOCUMENTS 3,540,402 A 11/1970 Kocher
3,606,096 A 9/1971 Campbell
3,768,501 A 10/1973 Elson et al.
3,774,658 A 11/1973 Abramoska, Jr.
3,802,606 A 4/1974 Gust
3,843,021 A 10/1974 Schieser
3,892,235 A 7/1975 Van Amerongen et al.
3,893,599 A 7/1975 Birell
3,920,149 A 11/1975 Fortino et al.
3,966,093 A 6/1976 Frahm et al.
3,973,602 A 8/1976 Kruse
3,974,863 A 8/1976 Frahm et al.
3,993,218 A 11/1976 Reichenberger
4,124,146 A 11/1978 Sealfon
4,137,930 A 2/1979 Scholle
4,239,130 A 12/1980 Altadonna
4,244,467 A 1/1981 Cavazza
4,267,945 A 5/1981 Maynard
4,356,848 A 11/1982 Spies
4,421,146 A 12/1983 Bond et al.
4,444,340 A 4/1984 Bond et al.
4,445,551 A 5/1984 Bond et al.
4,597,423 A 7/1986 Chenot
4,699,188 A 10/1987 Baker et al.
4,711,380 A 12/1987 Ulm
4,717,051 A 1/1988 Leclerc
4,722,463 A 2/1988 Anderson
4,793,514 A 12/1988 Sheets
4,834,267 A 5/1989 Schroer et al.
4,846,236 A 7/1989 Deruntz
4,874,023 A 10/1989 Ulm
4,898,308 A 2/1990 Rudick
4,902,320 A 2/1990 Schroer
4,972,976 A 11/1990 Romero
4,991,635 A 2/1991 Ulm
5,031,676 A 7/1991 Ulm
5,115,842 A * 5/1992 Crafts et al. ..... 141/286
5,121,778 A 6/1992 Baker et al.
5,133,482 A 7/1992 Burrows et al.
5,213,309 A 5/1993 Makishima
5,222,530 A 6/1993 Baker et al.
5,222,531 A 6/1993 Baker et al.
5,232,125 A 8/1993 Adams
5,259,534 A 11/1993 Lynd
5,273,083 A 12/1993 Burrows
5,289,854 A 3/1994 Baker et al.
5,289,855 A 3/1994 Baker et al.
5,295,518 A 3/1994 Baker et al.
5,295,519 A 3/1994 Baker et al.
5,337,922 A 8/1994 Salkeld et al.
5,395,590 A 3/1995 Swaniger et al.
5,413,152 A 5/1995 Burrows
5,431,205 A 7/1995 Gebhard
5,454,409 A 10/1995 McAffer et al.
5,464,127 A 11/1995 Burrows
5,526,961 A 6/1996 Burrows
5,533,651 A 7/1996 Eddy et al.
5,647,416 A 7/1997 Desrosiers et al.
5,653,270 A 8/1997 Burrows
5,676,278 A 10/1997 Bever et al.
5,711,380 A 1/1998 Chen
5,957,316 A 9/1999 Hidding et al.
6,029,860 A 2/2000 Donselman et al.
6,167,921 B1 1/2001 Busick et al.
6,352,183 B1 * 3/2002 Kristiansen et al. ..... 141/363
6,530,399 B2 * 3/2003 Nguyen et al. ..... 141/2
2004/0129723 A1 * 7/2004 Meder et al. ..... 222/113

OTHER PUBLICATIONS

Ebac Eddy Water Cooler for the Home: Discount Store UK.; Ebac Eddy is a Refreshing New Way to Enjoy a Health Lifestyle; http://www.freenet.ltd.uk/ebac_eddy.asp.

Watercoolers—Ebac Limited—Group Website. Manufacturer of dehumidifiers and water . . . ; Ebac Group; Watercoolers; http://www.ebacgroup.com/?page=21.

Latest News—Ebac Limited—Group Website. Manufacturer of dehumidifiers and water c . . . ; Ebac Group; Latest News; Ebac enters point of use market; http://www.ebacgroup.com/?page=36&art=22.

Home Spring Photos (14 images); http://henry-design.com/temp/mtn0503/060406_home_spring_photos/index.html.

* cited by examiner

BOTTOM LOAD WATER COOLER

RELATED COPENDING APPLICATIONS

Co-pending U.S. Ser. No. 11/382,114 filed May 8, 2006 and titled "Bottle Cap And Method Of Use With A Liquid Dispensing Apparatus And System" ("the Bottle Cap Invention") is hereby incorporated by reference in its entirety into this disclosure, as is U.S. Ser. No. 11/468,342, filed Aug. 30, 2006 and titled "Liquid Dispensing Apparatus And System" ("the Liquid Dispensing Invention").

BACKGROUND OF THE INVENTION

The present invention generally relates to a bottled water cooler and, more specifically, to a water cooler that loads bottles at a position below the dispensing spout, in a bottom portion of the cooler.

SUMMARY OF THE INVENTION

In a preferred embodiment, a liquid dispensing apparatus such as a water cooler is provided, which includes a dispenser for dispensing liquid to a user, and a liquid container such as a water bottle located below the dispenser. The liquid container may be removably attached to a pivoting cradle engaging the liquid container. The cradle may be permitted to pivot, such as about an axis located adjacent an exit location for liquid within the liquid container. The exit location may be the neck of a water bottle, for example. Alternatively, the cradle may pivot about an axis parallel to the longitudinal axis of the liquid dispensing apparatus. A filling device, such as a skirt for supporting the water bottle and an upstanding hollow feedstock or probe, may be located below the liquid container, for engaging the liquid container (such as for engaging a bottle cap engaged to a water bottle) in fluid communication with a reservoir(s), such as cold and hot water tanks in the water cooler. Dispensing of the liquid from the dispenser spout, for example, may be controlled by a manually accessible push-button located adjacent the dispenser.

Preferably, pivoting of the cradle engaged to the liquid container closes the water cooler door and also causes the liquid container to automatically be placed in fluid communication with the filling device.

A PCB or other on-board computer, solenoid valve(s), temperature sensors and one or more pumps may be provided in electrical communication with the hot and cold tanks, enabling a user to indirectly control dispensing of hot, room-temperature and/or cold water or other beverages. A device for boiling water within the hot tank may also be provided. Devices, such as an insta-boil sensor, venting valve(s) and emergency reservoir, may also be provided for removing excess water and/or vapor created by boiling water and for storing this excess water and/or vapor in the reservoir. One or more baffles may be associated with the cold and/or hot tanks.

A method for dispensing a liquid from a liquid dispensing apparatus (e.g., a water cooler) also forms part of the present invention. In this method, a dispenser is provided for dispensing the liquid to a user, and a liquid container is also provided, located below the dispenser and removably attachable to a pivoting cradle engaging the liquid container. The liquid container is engaged to the cradle, and the cradle is then pivoted about a pivot device, such as a skirt/probe combination, which may be located below the liquid container. The pivot axis may be generally perpendicular or generally parallel to a longitudinal axis of the dispensing apparatus. If generally perpendicular, the pivot axis may be located adjacent an exit location (e.g., a bottle neck) for liquid within the liquid container, so that the liquid container's neck faces down. The step of pivoting the cradle preferably causes the liquid container to be placed in automatic fluid communication with the filling device.

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which:

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Figure 1:
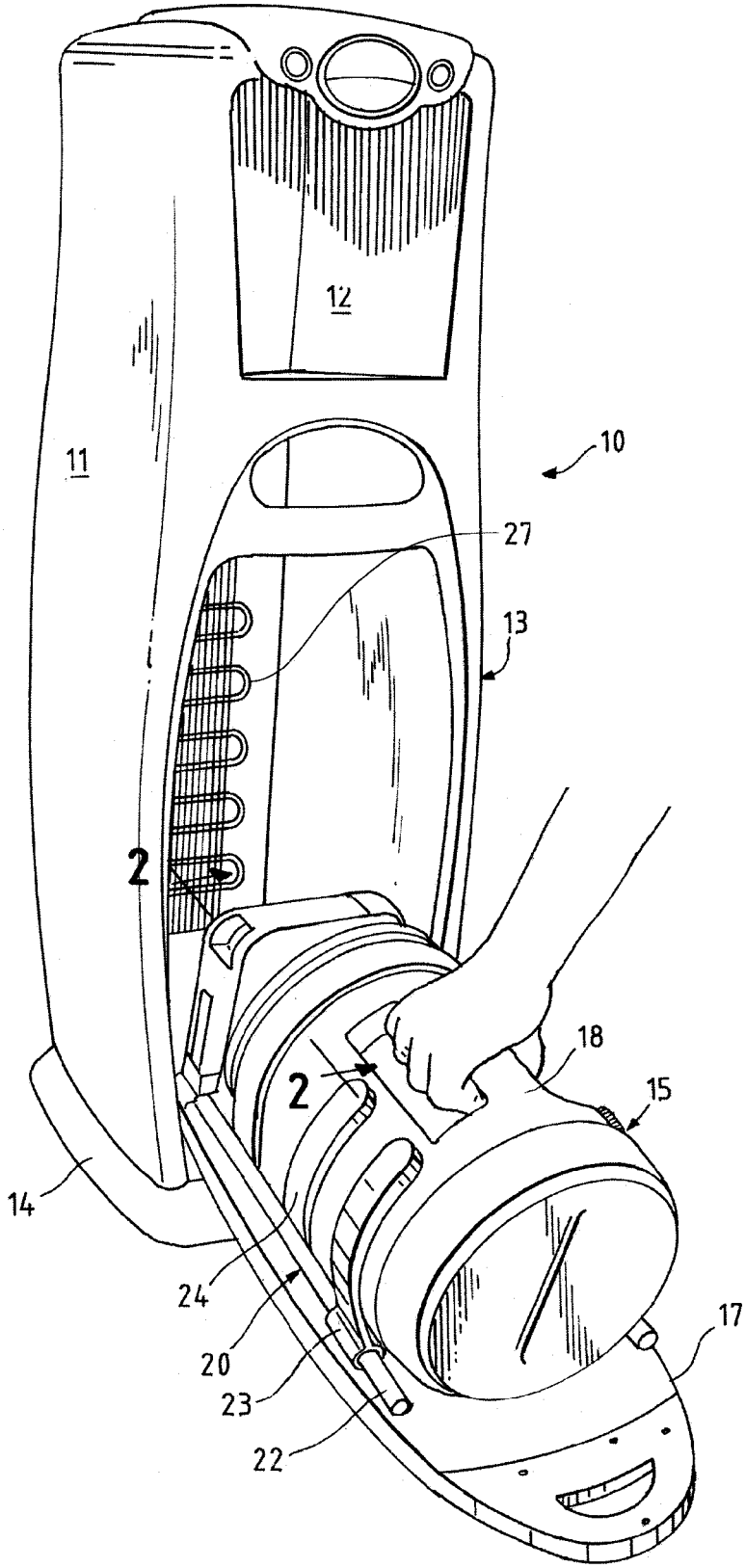
FIG. 1 is a front and side perspective view of a bottom load water cooler according to one preferred embodiment of the present invention, shown during loading of the water bottle.

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Referring first to FIGS. 1, 3 and 5-8, in a preferred embodiment of the present invention, a bottom load water cooler, generally designed by reference numeral 10, is shown. Bottom load water cooler 10 may include upstanding frame 11, an alcove 12 for liquid dispensing, a lower compartment 13, and a base 14. Lower compartment 13 may be opened such as by opening pivoting door 17 to accommodate the entry and exit of a water bottle 15, such as a 5-gallon water bottle. Condenser coils 27 may be located behind the engaged water bottle. Bottle 15 may include graspable handle 18.

A cradle may include structural members 22, such as bent metal tubes, attached to door 17 via retaining members or flange 23, such as a cylindrical metal flange 23. Clasps 24 may be attached to flange 23. Metal struts (spacers) 19 may be used to secure the cradle to the door. Once the water bottle has been secured to cradle 20, the door may be pivoted upward and closed in the direction of the arrows. The door and cradle should be made of sufficient rigidity and strength to support the water bottle weight. The pivot point for the door may be located at an end portion of the cradle, and may rest (directly or indirectly) on the base and transfer the load/weight to the base during door closure, as further explained below.

The pivoting point for the door/cradle is preferably located at an end portion of cradle 20, and may lie adjacent and/or on base 14 and transfers the load/weight to the base. To use the bottom load cooler of the present invention, a user may roll or carry a bottle containing liquid such as water to a front end of the open door/cradle from a storage area, place the bottle upright, tip over the bottle toward the door/cradle, and push the bottle into the direction of the bottom of the door/cradle. The bottle may be permitted to glide smoothly onto the cradle and engage the dispensing interface device, described below.

A variety of retaining devices, such as flexible rubber, plastic or metal clasps (shown) and/or a bungee cord (not shown) may be used if desired to secure the bottle's bottom area (opposite the neck) to the cradle, while the bottle's neck area has been secured to a filling device such as a hollow probe, as discussed below.

It will be appreciated that because the lifting point for door closure is preferably located at the distal end of the door/cradle opposite the bottle neck, a user may only need to lift about half of the bottle weight to close the bottle/cradle due to the leverage advantage.

Figure 5:
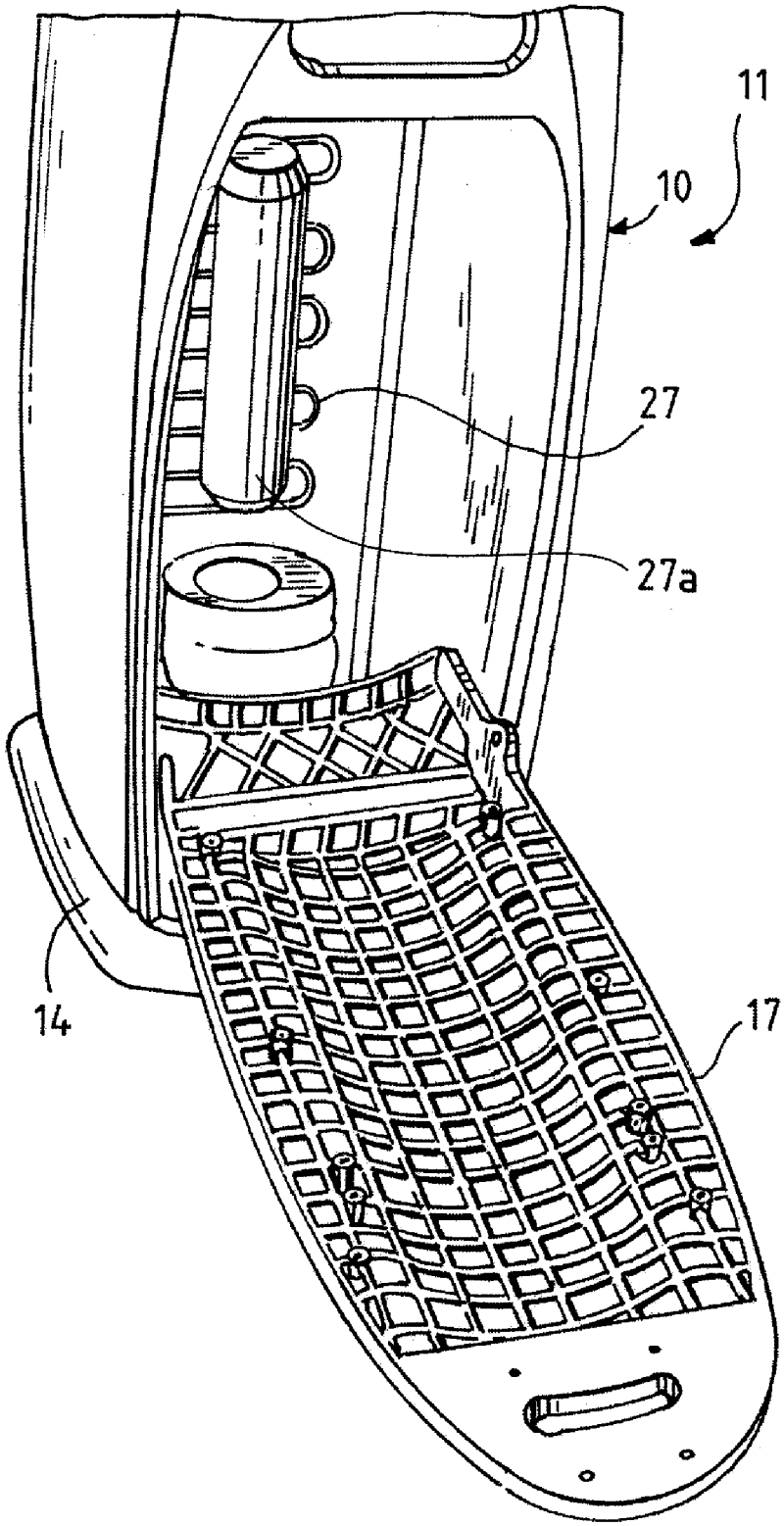
FIG. 5 is a partial (lower) front and side perspective view of the bottom load water cooler shown in FIGS. 1 and 3.
Figure 6:
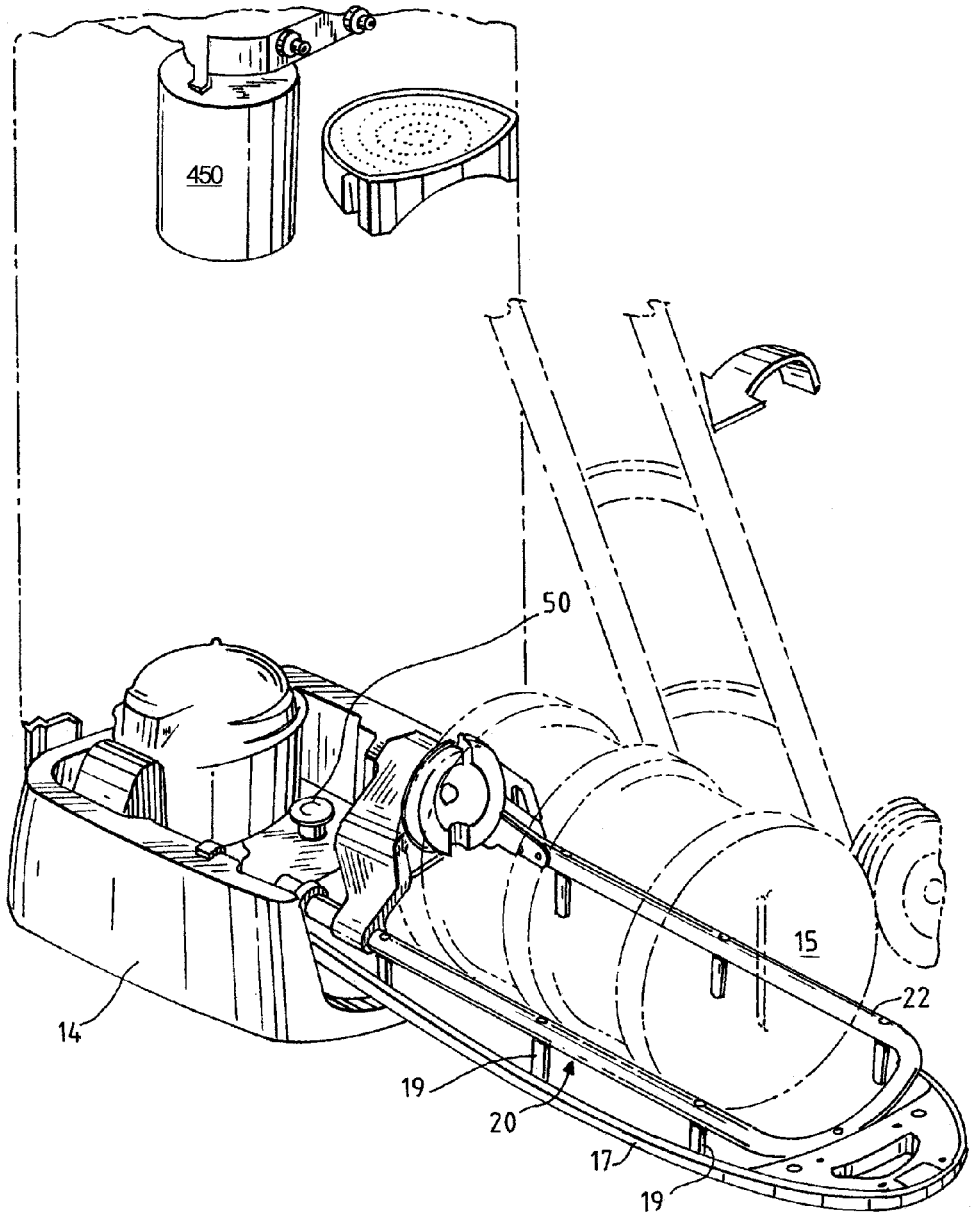
FIG. 6 is a partial side and front perspective view of the bottom load water cooler of FIG. 1, shown during the bottle loading process.
Figure 7:
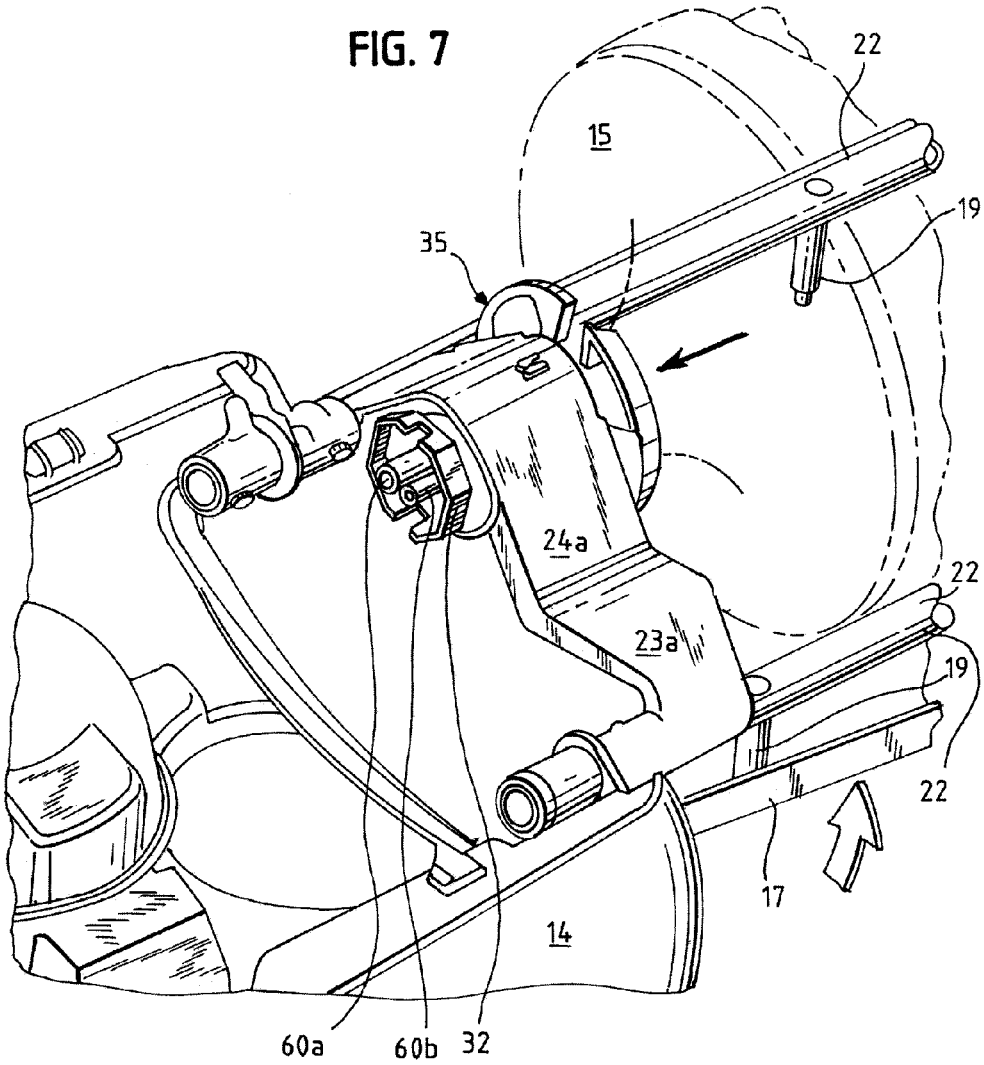
FIG. 7 is a partial, enlarged, side perspective view of FIG. 6.
Figure 8:
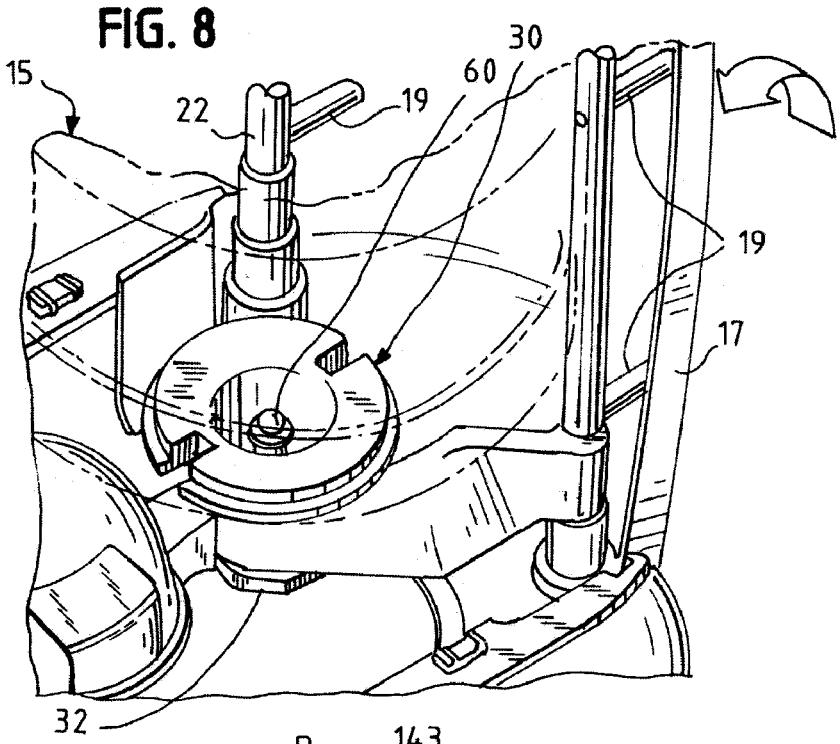
FIG. 8 is a view similar to FIG. 7, showing the water bottle in a fully raised condition, engaged and in fluid communication with the water cooler.
Figure 9:
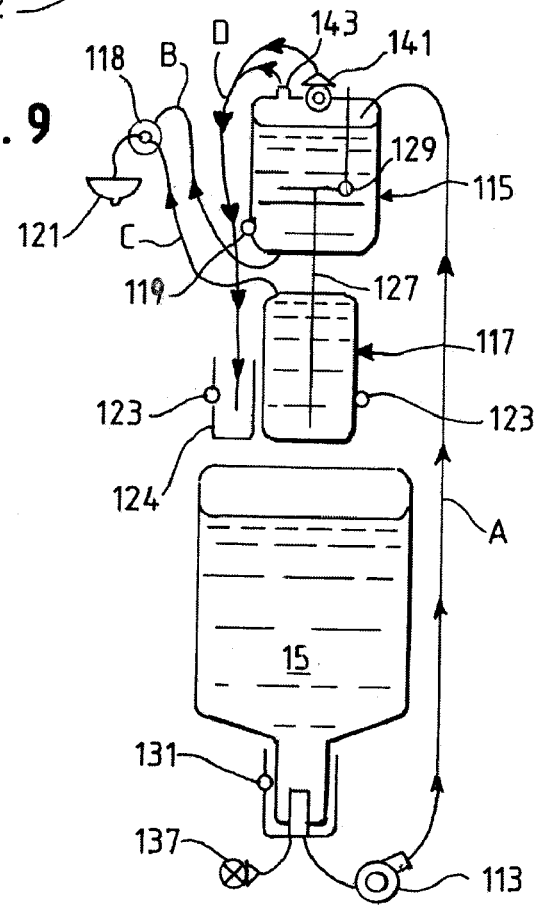
FIG. 9 is a schematic view showing one flow diagram useful with a preferred embodiment bottom loader water cooler of the present invention.

Referring to FIG. 5, a compressor 27*a* for the POU unit may be provided. A conventional drip tray (not shown) may be provided below dispenser spout 121 (FIG. 9).

Figure 2:
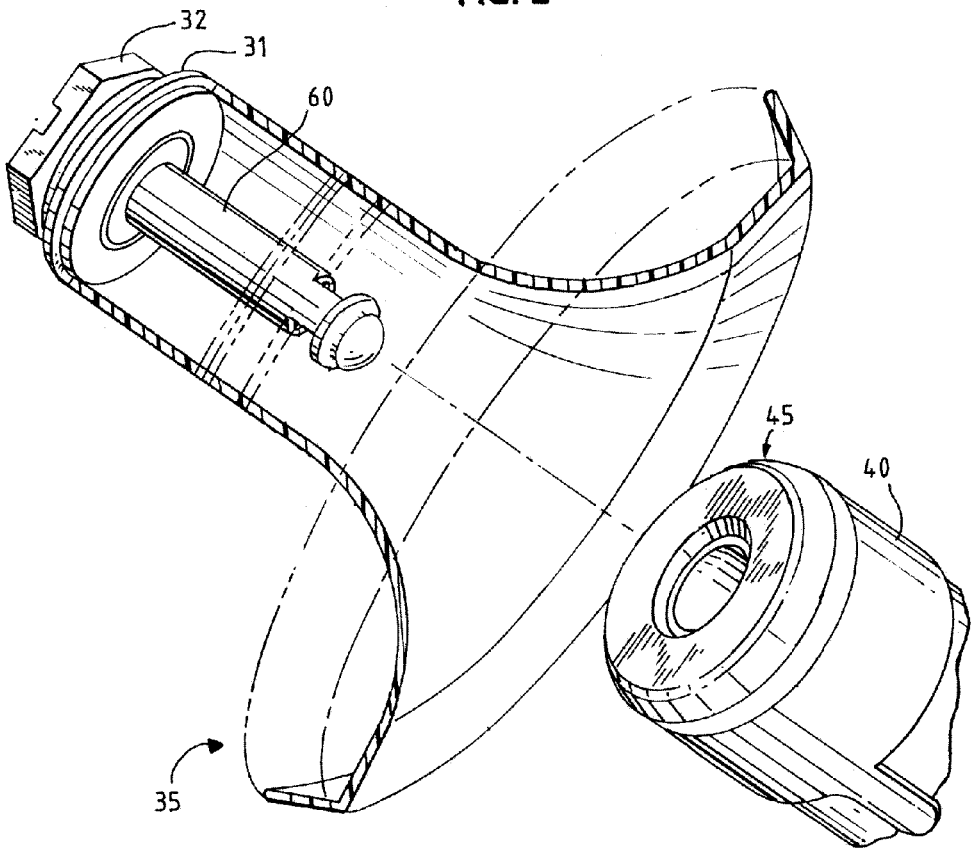
FIG. 2 is an enlarged, partial sectional and partial perspective view of the skirt for partially supporting the water bottle and the probe for penetrating and being in fluid communication with the water bottle, of the preferred embodiment of the present invention.
Figure 3:
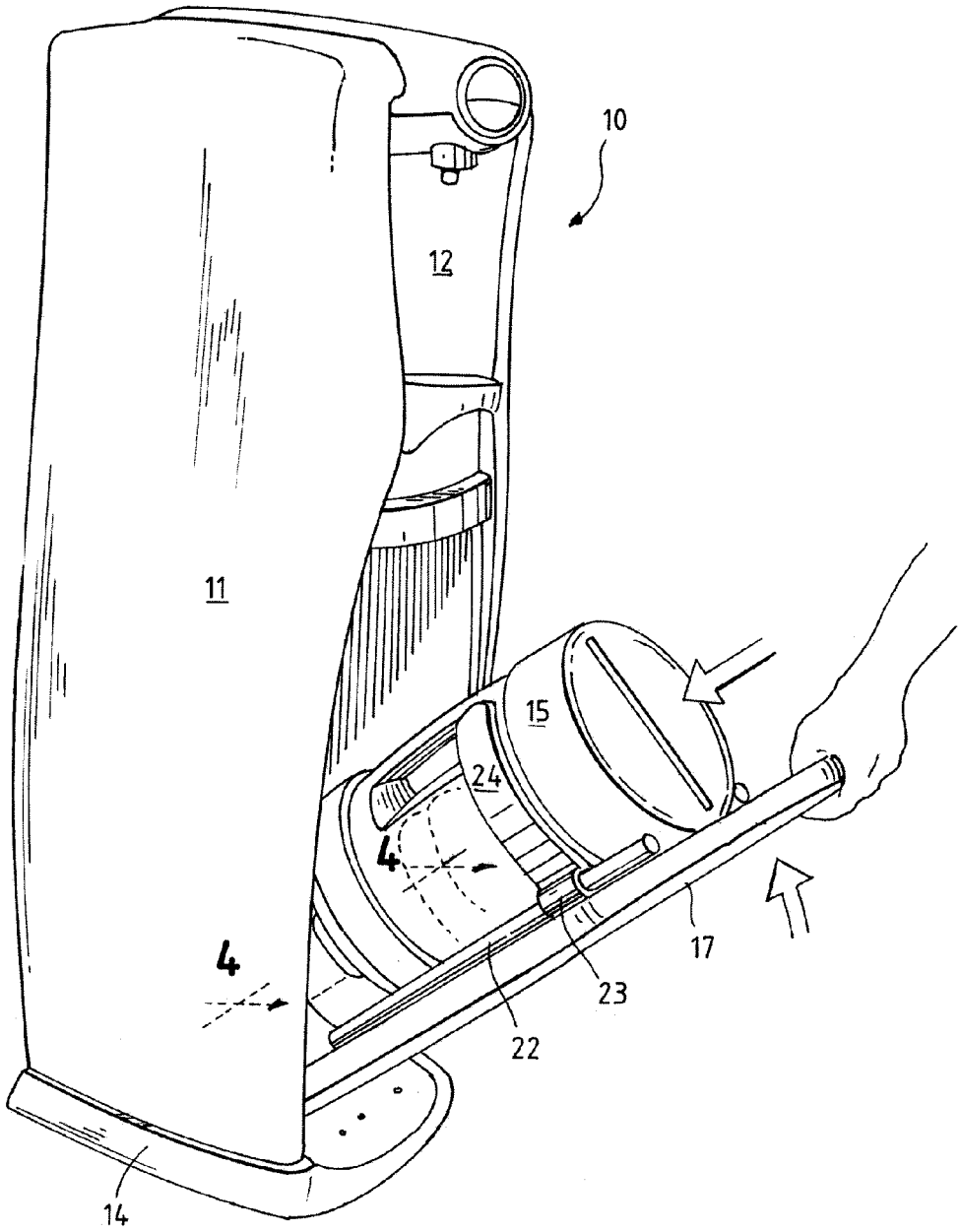
FIG. 3 is a side perspective view of the bottom load water cooler shown in FIG. 1.
Figure 4:
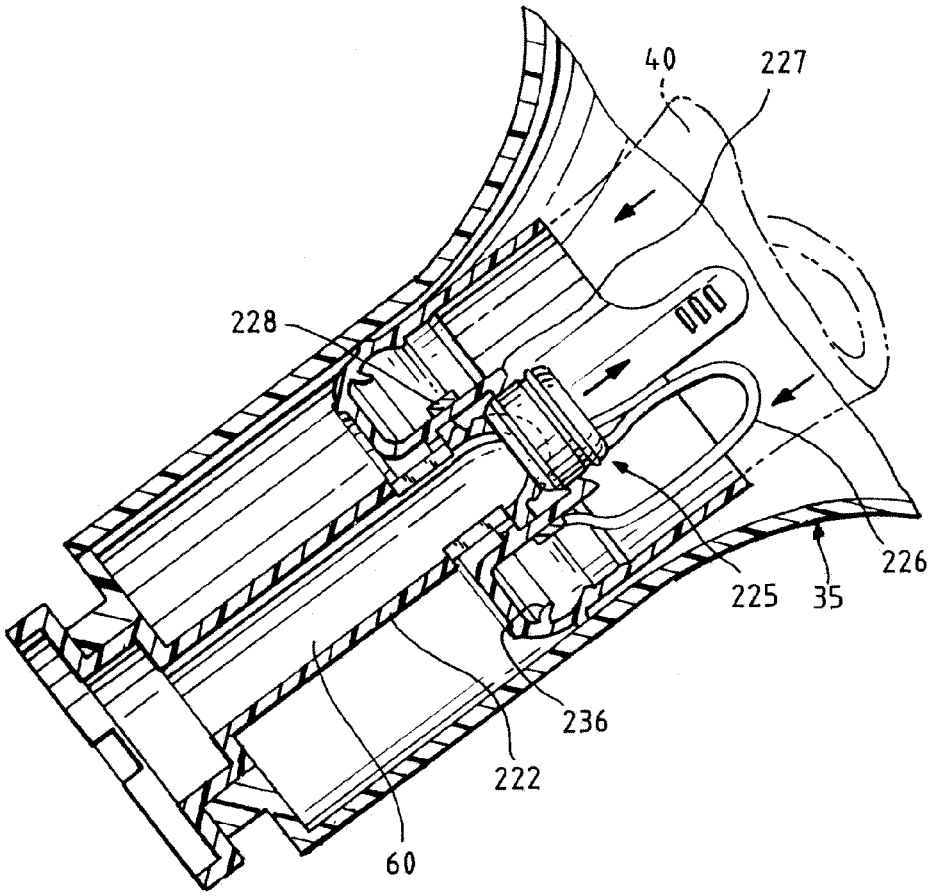
FIG. 4 is a sectional view showing the neck of the water bottle engagement to the probe of the water cooler.

Referring now to FIGS. 2 and 4, a preferred dispensing interface device is described. A water cooler base 50 (see FIG. 6) may be secured to an upstanding feedstock or probe 60. Probe 60 may have a probe base 32 and threaded proximal portion 31 for connection to an upper reservoir 450 (see FIG. 6). A skirt or bottle guard 35 may surround the probe (see also FIGS. 6-8), designed to carry the weight of the bottle via bottle neck 40 when the cradle is pivoted to an upright condition such that probe 60 is placed in fluid communication with bottle cap 45.

A conventional bottle cap may be employed. However, preferably, a bottle cap is employed such as shown in FIG. 2 of the Bottle Cap Invention, for example. In this embodiment, a cap plug 225, having an attached tether 226 and ring 228, is also provided. Ring 228 may be placed over the outer surface of inner wall 227. Cap plug 225 may then be inserted within inner wall 227 of bottle cap 40. A rib on the outer surface of cap plug 225 may be designed to provide a liquid-tight seal with an engaging lip on inner wall 227. Another seal occurs at cap sealing fin 236 against bottle cap 40. During dispensing, liquid may be permitted to flow from the liquid source down through the bottle neck and bottle cap 40, down through cap plug 225 (a pinhole, not shown, may be provided in the closed top for this purpose), through hollow probe 222. When the liquid source (e.g., water bottle) is empty, and is removed from the probe, bottle cap 40 with cap plug 225 intact may be removed as an integral piece from the probe, for example.

A conventional probe may be used to engage the water bottle, such as disclosed in U.S. Pat. No. 5,289,854 to Baker et al., while bottle caps of the type disclosed in U.S. Pat. No. 5,232,125 to Adams and U.S. Pat. No. 5,957,316 to Hidding et al., may be employed. The disclosures of these three patents are hereby incorporated by referenced herein in their entirety. However, a probe providing separate air and water flow paths 60*a*, 60*b* may be preferred (FIG. 7), such as disclosed in the Liquid Dispensing Invention.

Referring now to FIG. 9, one preferred liquid flow path for the bottom load water cooler of the present invention is shown. In this embodiment, cold tank 115 and hot tank 117 are positioned above water bottle 15. In order to fill and prime the tanks, water may be caused to flow along conduit A in the direction of the arrows from bottle 15, under pressure from water pump 113, into cold tank 115. Air flowing from the atmosphere through breathing check valve 137, preferably positioned close to the water bottle, may flow into bottle 15, avoiding air-lock and allowing continued dispensing. A vent solenoid valve 141 may be positioned at the top of cold tank 115, normally open, for switching the system open and closed, to render the cold tank an open system when necessary. Near valve 141, an emergency safety valve 143 may be employed to release the pressure inside the system in case the vent solenoid valve is malfunction. Cold tank temperature sensor 119 and hot tank temperature sensor 123 may be used to monitor and/or maintain temperatures in the tanks. Water sensor 123 may be used along with emergency reservoir 124 to send water along conduit D from the cold water tank to prevent overflows. 3-way solenoid 118 communicates along the flow path with spout 121, so that cold water may be provided from conduit B while hot water may be provided from conduit C. Baffle 127 may be provided within the tanks. Insta-boil sensor 129 may be located adjacent the baffle and within cold tank 115. Bottle sensor 131 may be used to sense bottle installation, triggering the start-up procedure.

In practice, and still referring to FIG. 9, as an example, a user may depress a water dispensing button, allowing a PCB (not shown) to transmit a signal to close vent solenoid valve 141 to render the system closed. 3-way solenoid valve 118 opens conduit B or C and water pump 113 starts pumping water up into cold tank 115, and dispenses water from spout 121. When the user releases the water dispensing button, the PCB transmits a signal to open vent solenoid valve 141 and render the system an open system. 3-way solenoid valve is closed to stop water dispensing, and water pump 113 ceases pumping. Using the insta-boil feature (e.g., an electric dispensing pot available from Zojirushi, Japan), the hot tank can boil water when desired by the user; excessive water/vapor generated by the boiling function may be bled from the system using the vent solenoid valve 141, emergency safety valve 143 and emergency reservoir 124.

The above description is not intended to limit the meaning of the words used in the following claims that define the invention. Other systems, methods, features, and advantages of the present invention will be, or will become, apparent to one having ordinary skill in the art upon examination of the foregoing drawings, written description and claims, and persons of ordinary skill in the art will understand that a variety of other designs still falling within the scope of the following claims may be envisioned and used. For example, the cradle may pivot along an axis either generally parallel or generally perpendicular to the longitudinal axis of the water cooler frame. Further, the cradle may, but need not be, attached to the door of the unit. Also, consumable liquids other than water, such as but not limited to carbonated beverages, may be dispensed. It is contemplated that these or other future modifications in structure, function or result will exist that are not substantial changes and that all such insubstantial changes in what is claimed are intended to be covered by the claims.

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

We claim:

1. A liquid dispensing apparatus, comprising:

a dispenser for dispensing liquid to a user;

a liquid container located below the dispenser and removably attached to a pivoting door, wherein the door pivots about an axis generally perpendicular to a longitudinal axis of the liquid dispensing apparatus, and wherein the pivoting axis is located adjacent an exit location for liquid within the liquid container;

a hollow probe, wherein pivoting of the door to a closed condition engages the liquid container and causes the hollow probe to extend into an opening of the liquid container placing the liquid container in fluid communication with the hollow probe, and wherein pivoting of the door leverages a user's ability to place the container into fluid communication with the probe; and a reservoir that is in fluid communication with the hollow probe, the reservoir being located above the liquid container.

2. The liquid dispensing apparatus of claim 1, wherein the pivoting door is coupled to a cradle engaging the liquid container.

3. The liquid dispensing apparatus of claim 1, wherein the liquid comprises water.

4. The liquid dispensing apparatus of claim 1, wherein the liquid container comprises a water bottle, and the exit location of the liquid container comprises a neck of the water bottle.

5. The liquid dispensing apparatus of claim 4, wherein the water bottle is engaged to a bottle cap and the probe is in fluid communication with the bottle cap.

6. The liquid dispensing apparatus of claim 1, wherein dispensing of the liquid from the dispenser is controlled by a manually accessible push-button located adjacent the dispenser.

7. The liquid dispensing apparatus of claim 1, wherein the reservoir comprises a cold tank, the cold tank being located above the liquid container.

8. The liquid dispensing apparatus of claim 7, wherein the cold tank is in fluid communication with a hot tank located above the liquid container, and both tanks are in fluid communication with the dispenser.

9. The liquid dispenser of claim 8, further comprising a solenoid valve in electrical communication with the hot and cold tanks, and a pump, enabling a user indirectly controlling the solenoid valve to dispense liquid from the dispenser.

10. The liquid dispensing apparatus of claim 8, further comprising temperature sensors associated with the cold and hot tanks.

11. The liquid dispensing apparatus of claim 8, further comprising a device for boiling water within the hot tank.

12. The liquid dispensing apparatus of claim 11, further comprising a device for removing excess water and vapor created by boiling water and for sending this excess water and vapor to a reservoir.

13. The liquid dispensing apparatus of claim 8, further comprising one or more baffles associated with the cold and hot tanks.

14. A liquid dispensing apparatus, comprising:

a dispenser for dispensing liquid to a user;

a liquid container located below the dispenser and removably attachable to a pivoting door engaging the liquid container;

a hollow probe wherein pivoting of the door engaged to the liquid container causes the liquid container to be placed in fluid communication with the hollow probe;

a cold tank, located above the dispenser, that is in fluid communication with the hollow probe and the dispenser; and a hot tank, located above the dispenser, that is in fluid communication with the cold tank and the dispenser.

15. The liquid dispensing apparatus of claim 14, wherein the pivoting door is coupled to a cradle for engaging the liquid container.

16. A method for dispensing a liquid from a liquid dispensing apparatus, comprising the steps of:

providing a dispenser for dispensing the liquid to a user, and a liquid container located below the dispenser and removably attachable to a pivoting cradle engaging the liquid container;

engaging the liquid container to the cradle;

pivoting the cradle about an axis located adjacent an exit location for liquid within the liquid container, wherein the container is located with the exit location facing down;

engaging the liquid container in fluid communication with a hollow probe wherein pivoting of the cradle engaged to the liquid container causes the liquid container to be placed in fluid communication with the hollow probe; and engaging the hollow probe with a bottle cap in removable fluid communication with the hollow probe;

engaging the hollow probe in fluid communication with a cold tank, located above the dispenser; and engaging the cold tank in fluid communication with the dispenser and a hot tank, located above the dispenser.

* * * * *